US006123147A

United States Patent [19]

Pittman

[11] Patent Number: 6,123,147

[45] Date of Patent: Sep. 26, 2000

[54] HUMIDITY CONTROL APPARATUS FOR RESIDENTIAL AIR CONDITIONING SYSTEM

[76] Inventor: Jerry R. Pittman, 10200 Penzance La., Royal Palm Beach, Fla. 33411

[21] Appl. No.: 08/683,391

[22] Filed: Jul. 18, 1996

[51] Int. Cl.[7] ..... F25B 29/00; F25D 17/06

[52] U.S. Cl. ..... 165/228; 165/263; 165/293; 165/63; 165/64; 62/90; 62/173; 62/238.6; 237/19

[58] Field of Search ..... 165/228, 225, 165/263, 293, 63, 64; 62/90, 173, 238.6; 237/19

[56] References Cited

U.S. PATENT DOCUMENTS

| | | | |
|---|---|---|---|
| 2,111,618 | 3/1938 | Erbach | 165/228 |
| 2,195,781 | 4/1940 | Newton | 165/228 |
| 2,257,915 | 10/1941 | Newton . | |
| 2,257,975 | 10/1941 | Miller et al. . | |
| 2,266,238 | 12/1941 | Newton . | |
| 2,734,348 | 2/1956 | Wright | 62/6 |
| 2,966,342 | 12/1960 | Newton | 165/228 |
| 3,670,808 | 6/1972 | Wait, Jr. . | |
| 3,693,704 | 9/1972 | Newton . | |
| 3,786,859 | 1/1974 | Day | 165/228 |
| 3,989,097 | 11/1976 | Schildknecht | 165/228 |
| 4,178,907 | 12/1979 | Sweat, Jr. | 237/19 |
| 4,227,382 | 10/1980 | Coyne . | |
| 4,271,898 | 6/1981 | Freeman . | |
| 4,281,519 | 8/1981 | Spath et al. | 237/19 |
| 4,371,111 | 2/1983 | Pernosky | 237/19 |
| 4,469,935 | 9/1984 | Candela . | |
| 4,641,631 | 2/1987 | Jatana . | |
| 4,770,001 | 9/1988 | Kittler . | |
| 4,823,557 | 4/1989 | Bottom, Jr. et al. . | |
| 4,852,363 | 8/1989 | Kampf et al. . | |
| 5,046,478 | 9/1991 | Clawson . | |
| 5,181,552 | 1/1993 | Eiermann | 165/228 |
| 5,239,838 | 8/1993 | Tressler . | |
| 5,263,892 | 11/1993 | Vandervaart . | |
| 5,265,433 | 11/1993 | Eiermann | 62/173 |
| 5,305,822 | 4/1994 | Kogetsu et al. . | |
| 5,493,871 | 2/1996 | Eiermann | 62/173 |

*Primary Examiner*—John K. Ford
*Attorney, Agent, or Firm*—Quarles & Brady

[57] ABSTRACT

A system for controlling the humidity with a residential air conditioning system without compressor or air flow control employs a simple control technique of matching inlet air temperature prior to the refrigeration coils of the air conditioning system to outlet temperature after the refrigeration coil and as raised by a reheat coil supplied with hot water from the residential hot water heater. The system permits heating and cooling cycles and may be retrofit into existing residential units.

11 Claims, 3 Drawing Sheets

HUMIDITY CONTROL APPARATUS FOR RESIDENTIAL AIR CONDITIONING SYSTEM

FIELD OF THE INVENTION

The invention relates generally to air conditioning systems suitable for use in a residential dwelling and in particular to a system for modifying such air conditioning systems to provide for humidity as well as temperature control.

BACKGROUND OF THE INVENTION

Residential air conditioning systems provide refrigeration coils within a plenum of a forced air furnace. The furnace blower circulates air across the refrigeration coils, cooling the air, and distributes the cooled air through the house. As the air is cooled, water in the air may condense onto the refrigeration coils and be conducted to a drain. Thus the air conditioning system both cools and dehumidifies the air of the home.

Normally, in a home system, the dehumidification of air is incidental to the primary objective of cooling the air. Depending on the heat and humidity load imposed by the location and construction of the house itself, the amount of dehumidification will vary considerably. In particular, for a well-insulated house imposing relatively little heat load, the cooling of the air to the desired temperature may be insufficient to remove the humidity present in the house.

In commercial air conditioning systems, both the temperature and the humidity may be controlled by adjusting the compressor speed and/or air speed and by using reheaters which effectively add a heat load to the building. Such systems are relatively expensive and require sophisticated control technology. Further, the ability to control the compressor speed and air flow is not normally available in a residential installation.

SUMMARY OF THE INVENTION

The present invention provides a humidity control system that may be easily retrofitted or added to a residential air conditioning system. The humidity control system uses hot water from the residential hot water heater to reheat air exiting from the refrigeration coils. The flow of the hot water to the reheat coil is adjusted to match the temperature of the air exiting the refrigeration coil with the temperature of the air entering the refrigeration when excess humidity is indicated. After the proper air temperature has been achieved, the air conditioner continues to run with the reheat coil operating. Using the reheat coil to match the inlet and outlet temperature ensures that the room temperature will not be changed while dehumidification is being performed. The controls necessary to match the inlet and outlet temperatures may be simple and inexpensive and easily adapted to existing home air conditioning systems.

More specifically, the present invention provides a humidity control kit to be used with a residential air conditioning system having a refrigeration coil in an air plenum and with a residential hot water heater having a cold water inlet and hot water outlet connected to a hot water tank. The invention includes a reheat coil, sized to fit downstream of the refrigeration coil in the air plenum, and an inlet temperature monitor, measuring the temperature of the air upstream of the refrigeration coil, and an outlet temperature monitor measuring the temperature of the air downstream of the reheat coil. A pump unit circulates water from the hot water tank through the reheat coil.

A controller communicating with a humidistat causes cooling of the refrigeration coils to lower the temperature of the air entering the air plenum and causes circulation of water through the reheat coil to raise the temperature of the air leaving the air plenum until the inlet temperature monitor indicates a temperature equal to that indicated by the outlet temperature monitor when the humidistat indicates that the ambient humidity is above a desired humidity set point.

It is one object of the invention to provide a simple humidity control kit suitable for use in a residential environment. Measurement of two temperatures and a simple control of the circulation of hot water to equalize those temperatures provides independent control of humidity without the need to control the speed of air circulation, the temperature of the refrigeration coils, the compressor speed, or the use of complex temperature anticipation strategies that require knowledge of the heat and humidity loads of the living area being dehumidified.

The system may include a thermostat accepting a desired temperature set point and measuring an ambient temperature. The controller communicates with the thermostat to cause cooling of the refrigeration coil but no circulation of the water through the reheat coil when the humidistat indicates that the ambient humidity is below a desired humidity set point and the desired temperature set point is below the ambient temperature.

Thus it is another object of the invention to provide a humidity controlling kit that simply integrates with conventional residential air conditioning systems to provide cooling as well as humidity control. When the air needs to be cooled, the cooling process, with its ancillary dehumidification, takes priority over the dehumidification process thus saving energy.

The controller may cause circulation of water through the reheat coil but no cooling of the refrigeration coil when the thermostat indicates that the desired temperature set point is above the ambient temperature.

Thus, it is another object of the invention to provide short term heating by using the reheat coil without the refrigeration coil.

The residential air conditioning system may include a heat discharge coil typically located outside the building and in thermal communication with a heat recovery unit. The heat recovery unit may receive water from the reheat coil to preheat water returning to the water heater.

Thus, it is another object of the invention to recycle the heat removed from the air in the plenum by the refrigeration coil into the reheat coil thereby improving energy efficiency.

In a simpler embodiment, the inlet temperature monitor and outlet temperature monitor may be eliminated and replaced by a metering valve that may be preset to control the amount of water circulation through the reheat coil so that, when the pump is operating and the refrigeration coil is being cooled, the air temperature upstream of the refrigeration coil substantially equals the air temperature downstream from the reheat coil. The controller causes circulation of water when the humidistat indicates that an ambient humidity is above a desired humidity set point.

Thus, it is another object of the invention to provide a cost effective humidity control system recognizing that the amount of heat removed from air by the refrigeration coils may be balanced with the amount of heat returned to the air by the reheat coil simply through the use of a metering valve metering the flow of temperature controlled water from a residential hot water heater.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

DETAILED DESCRIPTION OF THE PREFERRED EMBODIMENT

Figure 1:
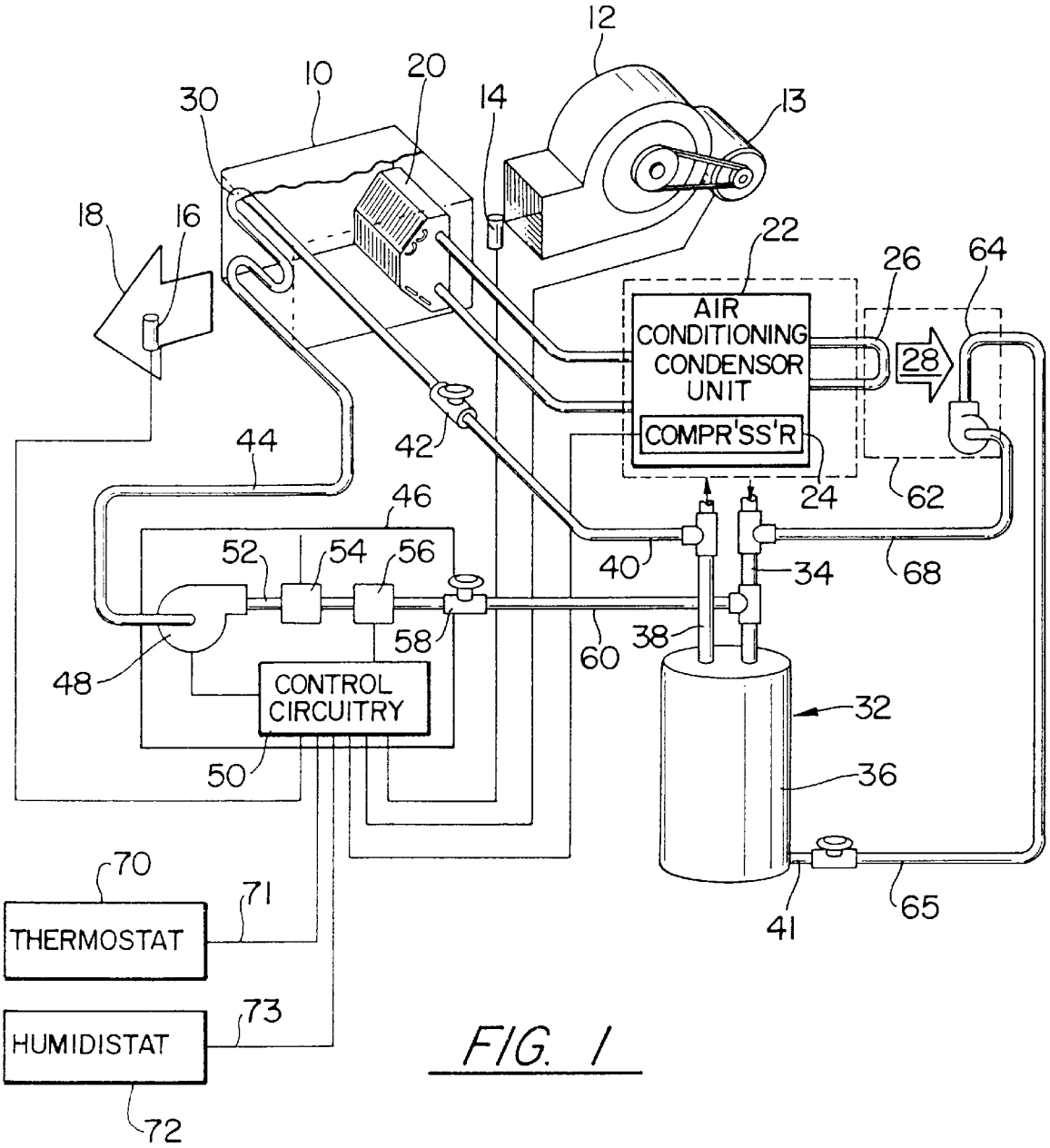
FIG. 1 is a perspective block diagram of the elements of the present invention as used with a typical home air conditioning system and a hot water heater, and showing control circuitry controlling a reheat coil.

Referring to FIG. 1, an air plenum 10, through which air is forced by blower 12, attaches to standard duct work (not shown) communicating to air registers and returns in a residential dwelling.

An inlet temperature monitor 14 is positioned between the blower 12 and plenum 10 to measure the temperature of the air entering the plenum 10. An outlet temperature monitor 16 correspondingly measures the temperature of air exiting the plenum 10. Such temperature monitors 14 and 16 may be thermocouples such as are well known in the art.

Positioned at the inlet of the plenum 10 is a standard refrigeration coil 20 receiving refrigerated coolant and returning used coolant to an air conditioning condenser unit 22 generally including a compressor 24. The condensor unit 22 also communicates with a heat recovery unit 62 as will be described. Such air conditioning systems are well known in the art and typically provide only for the turning on and off of the compressor but not for adjustment of compressor speed on an ongoing basis.

Air passing from the blower 12 into the plenum 10 passes over refrigeration coils 20 and is cooled when the air conditioning condenser unit 22 and the blower 12 are operating. The air exiting the plenum 10 then passes over a reheat coil 30 typically including a supporting matrix of conductive fins omitted for clarity. The reheat coil 30 receives water from a conventional hot water heater 32 as will now be described.

The hot water heater 32 comprises a hot water tank 36 communicating with a cold water makeup line 34, a hot water supply line 38 and a drain line 41. The cold water makeup line 34 provides cold water to the water heater tank 36 where it may be heated, preferably by a gas burner (not shown).

The cold water makeup line 34 is connected to the residential cold water supply and includes a first T-fitting to receive water from a heat recovery unit 62. As will be understood in the art, the heat recovery unit 62 includes an internal coil 64 receiving heat 28 from the working fluid of the air conditioning system 22 via line 26 to preheat the water in coil 64 which is then pumped (when the air conditioner is operating) through pipe 65 through the drain line 41 back to the water heater 32. Such heat recovery systems are well known in the art.

The hot water supply line 38 provides hot water to the residence at an essentially constant temperature determined by a thermostat control and also includes a T-fitting attached to an insulated copper water line 40. Line 40 passes through a shut-off valve 42 then to the reheat coil 30. From the reheat coil 30 an additional insulated copper line 44 brings the water, cooled by the air passing over the reheat coil 30, to a pump box 46 housing an electric water pump 48, auto air bleed 54, a modulating control valve 56, and control circuitry 50.

Water in line 44 is received by the pump 48 to be pumped along an additional water pipe 52 (when the pump is activated by the control circuitry 50) through the auto air bleed 54 to a modulating control valve 56. The modulating control valve provides a variable opening as controlled by the control circuitry 50 as will be described below.

The modulating control valve 56 is in turn connected to a second shut-off valve 58 which is in turn connected by insulated pipe 60 to a second T-fitting on the cold water makeup line 34.

The control circuitry 50 in addition to providing signals controlling the pump 48 and the modulating control valve 56, receives temperature signals from the inlet temperature monitor 14 and the outlet temperature monitor 16. Control circuitry 50 also provides a signal controlling the compressor 24 of the air conditioning condenser unit 22 and the motor 13 associated with the blower 12.

A thermostat 70, providing a temperature set point entered by a user and an ambient temperature reading of the surrounding air, provides a temperature control signal 71 to the control circuitry 50 indicating whether heating or cooling is desired in light of the temperature set point. As is understood in the art, such thermostats typically include a dead band at which neither heating nor cooling is desired and anticipator circuitry to offset the effect of lag in temperature control on a typical heating system. The thermostat 70 may also include a number of other features associated with conventional thermostats such as timed setback and the like.

Also attached to control circuitry 50 is a humidistat 72 which operates in a manner similar to that of the thermostat 70 but is sensitive to the humidity of the ambient air receives a desired humidity set point by the user and provides a humidity control signal 73 to the control circuitry 50 indicating whether dehumidification is required.

Figure 2:
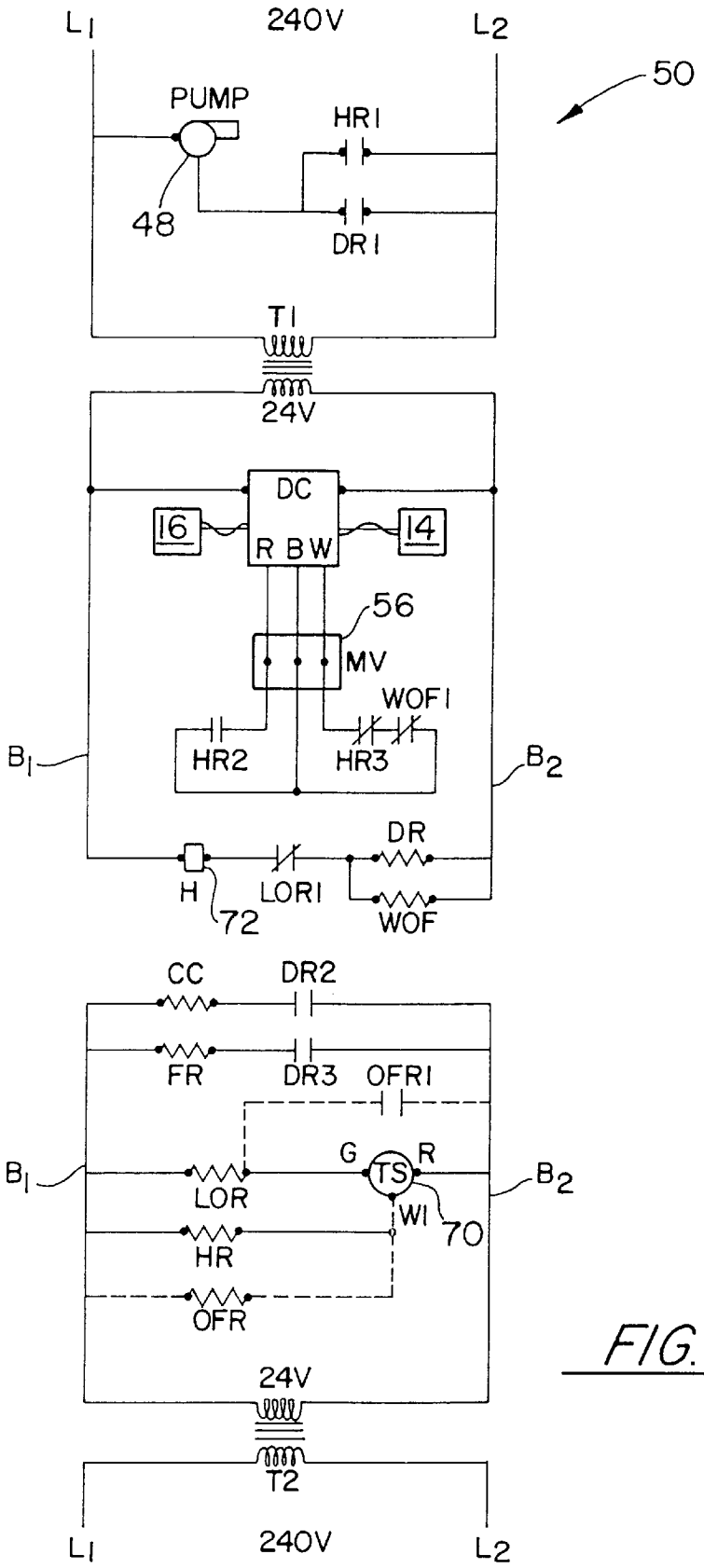
FIG. 2 is a schematic diagram of the control circuitry of FIG. 1.

Referring now to FIG. 2 the control circuitry 50 of the present invention may be implemented with conventional HVAC control elements. The pump 48 is connected across the household wiring indicated by rails $L_1$ and $L_2$ is in series with the parallel combination of a heat relay contact HR1 and a dehumidification relay contact DR1 both contacts being normally open. Thus, when either the heat relay contact HR1 or the dehumidification contact DR1 is closed, the pump 48 will be activated. This reflects the fact that the pump 48 is used during heating and dehumidification.

A transformer T1 reduces the line voltage of approximately 240 volts on rails $L_1$ and $L_2$ to 24 volts on rails $B_1$ and $B_2$ to provide power to a differential controller DC. Differential controller DC also receives signals from temperature monitors 14 and 16 and operates to provide a control voltage on lines R, B and W to modulating control valve modulating control valve MV (56). As the temperature indicated by inlet temperature monitor 14 rises above the temperature indicated by outlet temperature monitor 16 the differential controller DC provides a signal to the modulating valve MV opening that valve to allow more hot water to flow to the reheat coil 30. Conversely, as the temperature indicated by inlet temperature monitor 14 drops below the temperature indicated by outlet temperature monitor 16, the differential controller DC provides a signal to the modulating valve MV closing that valve to allow less hot water to flow to the reheat coil 30.

Shorting lines R and B of the differential controller DC causes the modulating valve MV to open fully whereas shorting lines B and W causes the modulating valve MV to close completely. A second set of heater contacts HR2 shunting the R and B lines thus open the modulating valve when heating is required whereas the series combination of a normally closed third set of heater contacts HR3 and water off contact WOF1 closes the modulating valve MV when no heat is required and no water is required for dehumidification.

Such differential controllers and modulating values are well known in the art and are manufactured by Honeywell of Golden Valley, Minn.

The power rail $B_1$ is also connected to a humidistat H providing normally open contacts which are followed by normally closed lock out contacts LOR1 which serve to lock out the dehumidification in the thermostat 70 indicates that cooling is required, as will be described. The lockout contacts LOR1 are in series with the parallel combination of the dehumidification relay coil DR (controlling contacts DR1, DR2, and DR3) and the water off relay coil WOF (controlling contacts WOF1).

Connected to a second transformer T2 providing a 24 volt supply across rails power rail $B_1$ and $B_2$ is a condenser contactor coil CC in series with normally open dehumidification relay contacts DR2. Thus only if dehumidification is occurring will the air conditioning system compressor 24 be activated. The contactor coil CC controls contacts (not shown) that turn on the compressor 24 (shown in FIG. 1).

Also connected across power rail $B_1$ and $B_2$ is a fan relay coil FR connected in series with normally open dehumidification contacts DR3. The fan relay coil controls relay contact (not shown) controlling blower 12 (FIG. 1) which will be activated during the dehumidification cycle. The blower 12 will also be activated during heating or cooling by the thermostat 70 or by an optional fan relay coil OFR to be described.

The thermostat TS (70) is also connected across power rail $B_1$ and $B_2$. The thermostat having three terminals designated per the industry G, R and W1. As is understood in the art, the thermostat TS provides electrical connection between the G and R terminals if cooling is required and between the W1 and R terminals if heating is required. The R terminal is connected to power rail $B_2$. The G terminal connects on one side to the lockout relay coil LOR which has the other side connected to power rail $B_1$. Lockout relay coil LOR controls the contacts LOR1 described above.

The W terminal is connected to the heat relay coil HR (controlling contacts HR1, HR2, and HR3 described above) which has its other side connected to the power rail $B_1$. Thus when cooling is required, the current passes through the lockout relay coil LOR and when heating is required, the current passes through the heat relay coil HR.

If the thermostat TS is of a type that does not automatically energize the blower 12 when heat is required, an additional fan relay coil OFR is connected between terminals W1 and $B_1$ and additional contacts OFR1 driven by the coil OFR are placed between terminals G and R of the thermostat TS and other contacts (not shown) turn on the blower 13.

Figure 3:
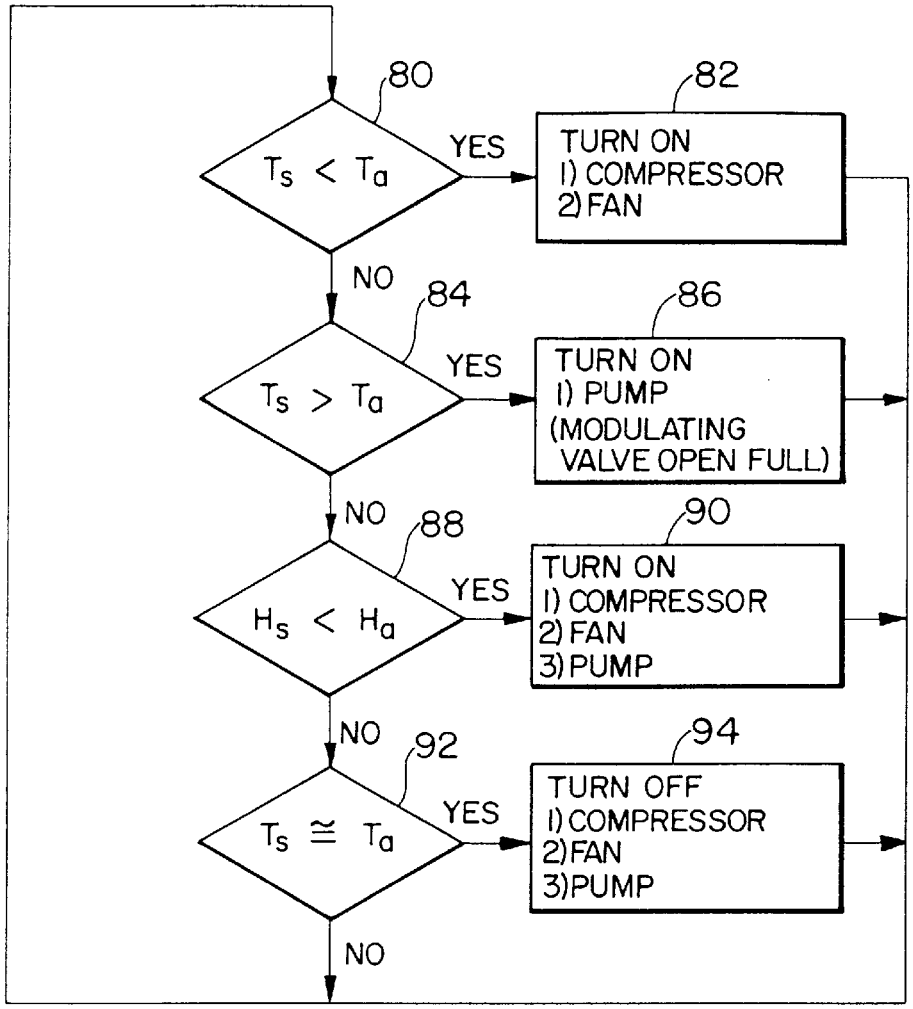
FIG. 3 is a flow chart showing the operation of the control circuitry of FIG. 1 and FIG. 2 in controlling humidity.

Referring now also to FIGS. 1 and 3, the operation of the control circuitry 50 may be described. At decision block 80, a determination is made by the control circuitry 50 (FIG. 1) whether the temperature set point $T_s$ is lower than the ambient temperature $T_a$ as determined from the signal from the thermostat 70. If so, the control circuitry 50 turns on the air conditioning system compressor 24 and the blower 12 to circulate cooled air as indicated by process block 82. The process as depicted then loops back to process block 80 and continues to loop through process block 80 for as long as the ambient temperature is higher than the temperature set point. As will be understood, process block 80 only turns on the compressor and blower if they were not already on. This is a standard cooling cycle.

If at decision block 80, the ambient temperature $T_a$ is not greater than the temperature set point $T_s$, then the operation of the control circuitry 50 is such as to determine, as indicated by decision block 84, whether the temperature set point $T_s$ is greater than the ambient temperature $T_a$ indicating that heating is required. If so, then as indicated at process block 86, the pump 48 is turned on and the modulating control valve 56 opened fully. This heating cycle of decision block 84 and process block 86 is continued until the ambient temperature $T_a$ matches the temperature set point $T_s$.

It will be recognized that the conditions of decision blocks 80 and 84 are normally modified by the existence of a "deadband" during which the ambient temperature $T_a$ is considered close enough to the set point temperature $T_s$ as to be neither greater than nor less than the set point temperature $T_s$. Thus, the inequalities of decision block 80 and 84 should not be considered strict mathematical conditions but conditions that would normally indicate that cooling or heating respectively are required.

If at decision block 84, the temperature set point $T_s$ is not appreciably above the ambient temperature $T_a$, the control circuitry 50 evaluates the humidity at decision block 88. If the humidity set point $H_s$ is less than the ambient humidity $H_s$, indicating dehumidification is required, then the control circuitry 50, as indicated by process block 90, turns on compressor 24, blower 12, and pump 48. During this time, the modulating control valve 56 controls the flow of water through the reheat coil 30 so as to return as much heat to the air in the plenum 10 as was removed by the refrigeration coils 20. Thus the ambient temperature is not appreciably affected, however dehumidification is obtained by the cooling of the air by refrigeration coils 20.

Assuming the ambient temperature $T_a$ remains the same, the process of blocks 88 and 90 is repeated until the humidity level $H_a$ is brought to an acceptable point $H_s$. If, at any time during this process of blocks 88 and 90, however, the ambient temperature $T_a$ rises or falls, the control circuitry 50 returns to the process blocks 82 and 86 to make a corrective action.

If the ambient temperature $T_a$ and humidity $H_a$ are at a correct points as indicated by decision blocks 80, 84 and 88, the control circuitry 50 proceeds to decision block 92 where the ambient temperature $T_a$ is determined to be equal to the set point temperature $T_s$ or within the deadband. If this condition is true, the control circuitry turns off the compressor 24, the blower 12 and the pump 48 as indicated by process block 94.

Thus, the system of the present invention can be integrated simply and logically into existing air conditioning systems to provide humidity control. Note that in situations where the normal cooling action of the air conditioning system is such as to provide proper humidity levels process block 90 will not be invoked thus conserving power.

Figure 4:
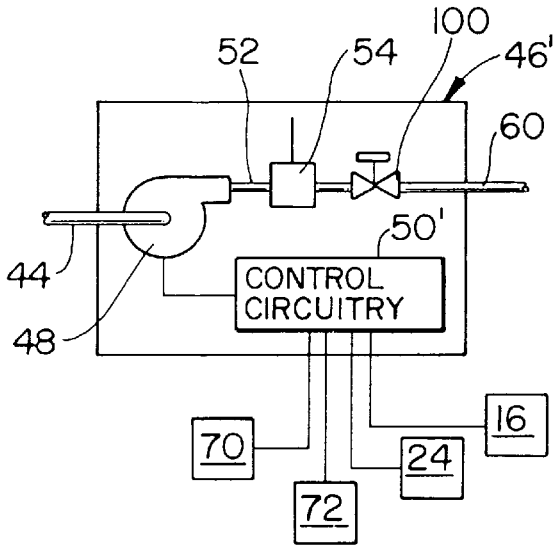
FIG. 4 is a figure showing a portion of FIG. 1 in an alternative embodiment where water through a reheat coil is controlled by a fixed metering valve rather than an electronically controlled modulating valve.

Referring now to FIG. 4, in an alternative embodiment, a pump box 46' differs from pump box 46 of FIG. 1 in that it has the modulating control valve 56 removed and replaced with a manual metering valve 100. This metering valve 100 is set up so that given a typical temperature of water from the water heater 32, temperature of the refrigeration coils 20, and air flow rate from the blower 12, the amount of hot water circulated through the reheat coil 30 will provide heat to the air in the plenum just balancing the heat removed by the refrigeration coils 20. Thus, control of the pump 48 on and off suffices to provide the dehumidification benefits of the present invention without unduly affecting the ambient temperature $T_a$ in the process.

It is noted that the temperature control of the air exiting the plenum 10 need not be precise as the effect of failure of complete temperature equality simply causes the activation of the heater or air conditioning system for brief periods of time during the dehumidification process. The fact that the present invention provides both a heating and cooling cycle as indicated by blocks 82 and 86 further reduces the necessary precision in this temperature control. Typically a control of plus or minus 2° is acceptable with greater latitude being permissible in certain applications.

The setting of valve 100 may be done by allowing the room temperature $T_a$ and humidity $H_a$ to approach their normal setpoints $T_s$ and $H_s$ respectively, and the temperature of the water in the hot water heater 32 to stabilize at its normal operating temperature. The air conditioning condenser unit 22 is then activated and valve 100 is manually adjusted until the measured temperature of the inlet air upstream of the refrigeration coil 20 equals the measured temperature of the air exiting from the plenum 10 after the reheat coil 30. Once this adjustment is made during normal use of the system, the metering valve 100 will provide the proper amount of water to the reheat coil 30 when the pump 48 is activated.

The above description has been that of a preferred embodiment of the present invention. It will occur to those that practice the art that many modifications may be made without departing from the spirit and scope of the invention. In order to apprise the public of the various embodiments that may fall within the scope of the invention, the following claims are made:

I claim:

1. A humidity control kit to be used with a residential air conditioning system having a refrigeration coil in an air plenum and with a residential hot water heater having a cold water inlet and hot water outlet connected to a hot water tank, the kit comprising:

a reheat coil sized-to fit downstream of the refrigeration coil in the air plenum;

an inlet temperature monitor measuring the temperature of the air upstream of the refrigeration coil;

an outlet temperature monitor measuring the temperature of the air downstream of the reheat coil;

a pump unit providing controlled circulation of water from the hot water tank via the hot water outlet, through the reheat coil and back to the hot water tank via the cold water inlet when the pump unit is connected to the hot water heater and reheat coil via piping;

a humidistat measuring an ambient humidity in air from the plenum; and a controller communicating with the inlet and outlet temperature monitors, the pump unit, and the air conditioning system to cause cooling of the refrigeration coils to lower the temperature of air entering the air plenum, and the circulation of water through the reheat coil to raise the temperature of air leaving the air plenum, so that inlet temperature monitor indicates temperature substantially equal to that indicated by the outlet temperature monitor, when the humidistat indicates that the ambient humidity is above a desired humidity setpoint.

2. The humidity control kit of claim 1 wherein the controller operates to:

(i) increase water circulation when the humidistat indicates that the ambient humidity is above a desired humidity setpoint and the inlet temperature monitor indicates a higher temperature than the outlet temperature monitor;

(ii) decrease water circulation when the humidistat indicates that the ambient humidity is above a desired humidity setpoint and inlet temperature monitor indicates a lower temperature than the outlet temperature monitor.

3. The humidity control kit of claim 1 wherein the residential air conditioning system includes a thermostat accepting a desired temperature setpoint and measuring an ambient temperature, and wherein the controller communicates with the thermostat to cause cooling of the refrigeration coil but no circulation of water through the reheat coil when the humidistat indicates that the ambient humidity is below a desired humidity setpoint and the desired temperature setpoint is below the ambient temperature.

4. The humidity control kit of claim 1 wherein the residential air conditioning system includes a thermostat providing a desired temperature setpoint and measuring an ambient temperature and wherein the controller communicates with the thermostat to cause circulation of water through the reheat coil but no cooling of the refrigeration coil when the thermostat indicates that the desired temperature setpoint is above the ambient temperature.

5. The humidity control kit of claim 1 wherein the pump unit includes a modulating valve having a variable opening to control the circulation of water according to a difference in the temperature indicated by the inlet temperature monitor and the temperature indicated by the outlet temperature monitor.

6. The humidity control kit of claim 1 wherein the residential air conditioning system includes a heat radiator coil, and including in addition, a heat reclamation unit in thermal communication with the heat radiator coil receiving water from the reheat coil to preheat water returning to the water heater.

7. A humidity control kit to be used with a residential air conditioning system having a refrigeration coil in an air plenum and residential hot water heater having a cold water inlet and hot water outlet connected to a hot water tank, the kit comprising:

a reheat coil sized to fit downstream of the refrigeration coil in the air plenum;

a pump unit providing controlled circulation of water from the hot water tank via the hot water outlet, through the reheat coil and back to the hot water tank via the cold water inlet when the pump unit is connected to the hot water heater and reheat coil via piping;

a metering valve in series with the pump unit and the reheat coil and adjustable to control the amount of water circulation so that when the pump unit is operating and the refrigeration coil is being cooled, the air temperature upstream of the refrigeration coil substantially equals the air temperature downstream from the reheat coil;

a humidistat measuring the ambient humidity in a room receiving air from the plenum;

a controller attached to the pump unit to cause the circulation of water through the reheat coil to raise the temperature of air leaving the refrigeration coil to substantially equal that of air entering the refrigeration coil when the humidistat indicates that an ambient humidity above a desired humidity setpoint.

8. The humidity control kit of claim 7 wherein the residential air conditioning system includes a thermostat accepting a desired temperature setpoint and measuring an ambient temperature, and wherein the controller communicates with the thermostat to cause cooling of the refrigeration coil but no circulation of water through the reheat coil when the humidistat indicates that the ambient humidity is below a desired humidity setpoint and the desired temperature setpoint is below the ambient temperature.

9. The humidity control kit of claim 7 wherein the residential air conditioning system includes a thermostat providing a desired temperature setpoint and measuring an ambient temperature and wherein the controller communicates with the thermostat to cause circulation of water through the reheat coil but no cooling of the refrigeration coil when the thermostat indicates that the desired temperature setpoint is above the ambient temperature.

10. The humidity control kit of claim 7 wherein the residential air conditioning system includes a heat radiator coil, and including in addition, a heat reclamation unit in thermal communication with the heat radiator coil receiving water from the reheat coil to preheat water returning to the water heater.

11. A method of setting a metering valve in a humidity control system to be used with a residential air conditioning system having refrigeration coils in an air plenum and a blower circulating air through the plenum and residential hot water heater having a thermostat having a cold water inlet and hot water outlet connected to a hot water tank, the system including a reheat coil sized to fit downstream of the refrigeration coil in the air plenum, a pump unit providing controlled circulation of water from the hot water tank via the hot water outlet, through the reheat coil and back to the hot water tank via the cold water inlet when the pump unit is connected to the hot water heater and reheat coil via piping, the metering valve in series with the pump; a humidistat measuring the ambient humidity in a room receiving air from the plenum and a controller attached to the pump unit to cause the circulation of water through the reheat coil to raise the temperature of air leaving the refrigeration coil to substantially equal that of air entering the refrigeration coil when the humidistat indicates that a ambient humidity above a desired humidity setpoint the method comprising the steps of:

a) cooling the refrigeration coil and turning on the blower for normal air conditioning operation;

b) setting the hot water heater thermostat for a predetermined temperature c) measuring air inlet temperature before the refrigeration coil and air outlet temperature after the reheat coil; and d) adjusting the opening of the metering valve until the air temperature before the refrigeration coil substantially equals the air temperature after the reheat coil.

* * * * *